US007261113B2

(12) United States Patent
Tartaglia

(10) Patent No.: US 7,261,113 B2
(45) **Date of Patent: *Aug. 28, 2007**

(54) STEP-UP CANE

(76) Inventor: John Tartaglia, 108 Stoddard Rd., Waterbury, CT (US) 06708

( * ) Notice: Subject to any disclaimer, the term of this patent is extended or adjusted under 35 U.S.C. 154(b) by 0 days.

This patent is subject to a terminal disclaimer.

(21) Appl. No.: 11/107,260

(22) Filed: Apr. 15, 2005

(65) Prior Publication Data

US 2005/0274405 A1 Dec. 15, 2005

Related U.S. Application Data

(60) Provisional application No. 60/562,668, filed on Apr. 15, 2004.

(51) Int. Cl.
*A61H 3/02* (2006.01)
*A45B 1/00* (2006.01)

(52) U.S. Cl. ..... 135/66; 135/69; 135/74; 135/84; 182/106; 297/423.41; 428/52

(58) Field of Classification Search ..... 135/65–66, 135/68–69, 74, 80, 84; 182/106, 132; 248/155.2, 248/155.3; 297/423.41, 423.44, 423.39, 297/183.3; D3/7–9; 108/129–132; 482/52–53
See application file for complete search history.

(56) References Cited

U.S. PATENT DOCUMENTS 1,307,058 A 6/1919 McGrath
1,520,518 A * 12/1924 Thomason ..... 108/64
2,244,869 A 6/1941 Everest et al.
D187,450 S 3/1960 Maxwell
3,133,551 A 5/1964 Murcott
3,157,187 A 11/1964 Murcott
3,165,314 A 1/1965 Clearman et al.

(Continued)

FOREIGN PATENT DOCUMENTS

GB 2057896 A 4/1981

(Continued)

OTHER PUBLICATIONS

Executed Declaration of John A. Tartaglia.

(Continued)

*Primary Examiner*—Winnie Yip
(74) *Attorney, Agent, or Firm*—Morgan, Lewis & Bockius LLP

(57) ABSTRACT

A cane having a substantially vertical member, a base attached to the substantially vertical member with at least three legs and a first tread proximate the substantially vertical member, a second tread moveably connected to the first tread, the second tread having at least one leg and being moveable from a retracted position to an extended position. A cane having a handle means for carrying the cane and for steadying a user of the cane, a platform means for stepping upon by the user, the platform means secured to the handle means and an extension means for retractably extending the platform means. A method of climbing a vertical rise that includes positioning, at a bottom of a vertical rise, a cane having an extendable platform, extending the platform, stepping upon the platform, stepping off the platform onto a surface higher than the bottom of the vertical rise; and retracting the platform.

14 Claims, 21 Drawing Sheets

U.S. PATENT DOCUMENTS 3,273,575 A * 9/1966 Aldrich ..... 135/77
3,350,095 A 10/1967 Clasen
D229,728 S 12/1973 Thomas
D230,531 S 2/1974 Thomas
3,884,327 A 5/1975 Zigman
4,044,784 A 8/1977 Smith
4,046,374 A 9/1977 Breyley
4,062,372 A 12/1977 Slusher
4,091,828 A 5/1978 Jorgensen
4,106,521 A 8/1978 Thomas
4,135,535 A 1/1979 Thomas
4,258,735 A 3/1981 Meade
4,274,430 A 6/1981 Schaaf et al.
4,341,381 A 7/1982 Norberg
4,342,465 A 8/1982 Stillings
4,378,862 A 4/1983 Carmel
D272,677 S 2/1984 Bove et al.
4,550,802 A * 11/1985 Roper ..... 182/113
4,559,962 A 12/1985 Marchiano
4,561,652 A * 12/1985 Wilkinson ..... 482/105
4,601,302 A 7/1986 Breen et al.
D290,186 S 6/1987 Meunchen
D295,694 S 5/1988 Mace
4,787,405 A 11/1988 Karwoski
4,796,648 A 1/1989 Goulter
4,834,127 A 5/1989 Van Sice
4,844,199 A * 7/1989 Nimz ..... 182/106
4,884,587 A 12/1989 Mungons
4,962,781 A 10/1990 Kanbar
4,974,871 A 12/1990 Mao
4,993,446 A 2/1991 Yarbrough
4,997,001 A 3/1991 DiCarlo
5,056,545 A 10/1991 Spaeth
5,090,434 A * 2/1992 Hagen ..... 135/66
D324,946 S 3/1992 Karten
5,112,044 A 5/1992 Dubats
5,127,664 A 7/1992 Cheng
5,131,494 A 7/1992 Heifetz
D329,538 S 9/1992 Rau
5,156,176 A 10/1992 Doorenbos
5,188,138 A 2/1993 Yamasaki et al.
5,201,334 A 4/1993 Tseng
5,238,013 A 8/1993 Battiston et al.
5,282,486 A 2/1994 Hoover
5,301,704 A 4/1994 Brown
5,307,828 A 5/1994 Gardner et al.
5,318,057 A 6/1994 Wallum
5,339,850 A 8/1994 Mertz
5,355,904 A 10/1994 Wallum
5,385,163 A 1/1995 Fairchild
5,390,687 A 2/1995 Tsai
5,392,800 A 2/1995 Sergi
5,392,801 A 2/1995 Hannoosh et al.
5,433,234 A 7/1995 Lapere
5,449,221 A * 9/1995 Stander ..... 297/423.4
5,482,070 A 1/1996 Kelly
5,495,867 A 3/1996 Block
5,499,645 A 3/1996 Baliga
5,588,457 A 12/1996 Tartaglia
5,636,651 A 6/1997 Einbinder
5,692,533 A 12/1997 Meltzer
5,746,288 A * 5/1998 O'Neal et al. ..... 182/118
5,785,070 A 7/1998 Block et al.
5,794,638 A 8/1998 Richey et al.
D401,192 S 11/1998 Gagnon
D411,343 S 6/1999 Brightbill et al.
D411,653 S 6/1999 Richey et al.
5,941,262 A 8/1999 Tschirhart
5,954,074 A 9/1999 Mattson
5,983,912 A * 11/1999 Leu ..... 135/66
6,003,532 A 12/1999 Pi
D422,747 S 4/2000 Evans
D428,367 S 7/2000 Lundh
6,158,453 A 12/2000 Nasco
D439,625 S 3/2001 Tamaribuchi
D441,162 S 4/2001 Grove et al.
6,217,056 B1 4/2001 Tsuchie
D444,605 S 7/2001 Porter
D448,151 S 9/2001 Outlaw
6,318,392 B1 11/2001 Chen
6,338,355 B1 1/2002 Cheng
D455,985 S 4/2002 Olivares
D457,840 S 5/2002 Hsia
6,454,357 B1 * 9/2002 Foulger ..... 297/423.41
6,494,469 B1 12/2002 Hara et al.
D468,669 S 1/2003 Hopely, Jr.
D480,995 S 10/2003 Owens
6,675,820 B2 1/2004 Balan
6,708,705 B2 3/2004 Nasco
6,715,794 B2 4/2004 Frank
D494,109 S 8/2004 Karasin et al.
6,877,519 B2 4/2005 Fink
D506,419 S 6/2005 Coster
2001/0038186 A1 11/2001 Wychozowycz
2003/0094191 A1 5/2003 Lin
2003/0111100 A1 6/2003 Bell et al.
2003/0205265 A1 11/2003 Nasco
2004/0216776 A1 11/2004 Otis
2005/0093326 A1 5/2005 Miller et al.

FOREIGN PATENT DOCUMENTS

JP 8-89322 * 4/1996
JP 10071181 3/1998
JP 2004357731 12/2004

OTHER PUBLICATIONS

U.S. Appl. No. 29/215,902, filed Oct. 25, 2004, Reed et al.
U.S. Appl. No. 29/215,901, filed Oct. 25, 2004, Vellrath.
U.S. Appl. No. 29/215,899, filed Oct. 25, 2004, Karasin et al.
U.S. Appl. No. 29/215,883, filed Oct. 25, 2004, Reed et al.
U.S. Appl. No. 29/215,882, filed Oct. 25, 2004, Vellrath.
U.S. Appl. No. 29/215,881, filed Oct. 25, 2004, Karasin et al.
U.S. Appl. No. 29/215,880, filed Oct. 25, 2004, Karasin et al.
U.S. Appl. No. 29/215,839, filed Oct. 25, 2004, Vellrath.
U.S. Appl. No. 29/215,837, filed Oct. 25, 2004, Vellrath.
U.S. Appl. No. 29/215,836, filed Oct. 25, 2004, Karasin et al.

* cited by examiner

STEP-UP CANE

REFERENCE TO RELATED APPLICATION

This application claims priority to U.S. Provisional Application No. 60/562,668 filed Apr. 15, 2004.

BACKGROUND OF THE INVENTION

This invention relates to articles useful in assisting a person with walking and climbing vertical rises. Ordinary canes require a person to lift the cane, move it forward, plant the cane, take a step to reach the cane and repeat the process. For those people who are unsteady on their feet, the period of time that the cane is aloft may cause strain on the joints and limbs and a loss of balance and possibly an injury or fall. A cane is, therefore, needed that can remain in contact with the ground at all time while a person is walking. There is also the need for such a cane to be equipped with a brake to prevent the cane from drifting during use.

Many people have difficulty climbing steep or vertical rises (e.g., steps, curbs, into automobiles). In the case of stairs, this difficulty is often due to the high riser on many standard and non-standard stairs. A device is needed that will enable those people to climb vertical rises reducing the height that they are required to lift their leg to climb the rise.

SUMMARY OF THE PREFERRED EMBODIMENTS

In one embodiment there is a cane having a substantially vertical member, a base attached to the substantially vertical member and having at least three legs and having a first tread proximate the substantially vertical member, a second tread moveably connected to the first tread, the second tread having at least one leg and being moveable from a retracted position to an extended position. In a further embodiment, there is a cane having a first tread and a second tread that are configured to form a platform upon which a person may step. In a still further embodiment, there is a cane having a second tread that is moveably connected to a first tread by a hinged securement. In yet a further embodiment, there is a cane configured to be free-standing in a retracted position and in an extended position. In a further embodiment, there is a cane having a second tread that is foldable relative to a first tread. In one embodiment, a first tread has four legs. In another embodiment, a second tread has two legs. In another embodiment, there is a cane having a first tread with four legs, two of the four legs being proximate an upright and two of the four legs being proximate a hinged securement, and wherein a second tread has two legs proximate an outer edge of the second tread. In one embodiment, there is a cane that is configured for a first tread to be positioned between a surface upon which the cane stands and a higher surface. In one embodiment, there is a cane having a first tread and a second tread that are configured to form a extended platform configured to fit on a stair tread. In another embodiment, a cane has a substantially vertical member that includes a plurality of uprights. In a further embodiment, there is a cane with a substantially vertical member oriented proximate a side of a base such that the substantially vertical member is disposed between a majority of the first tread and a side of the base. In another embodiment, there is a cane having at least two of three legs that are disposed on a side of a base wherein the substantially vertical member is disposed between substantially all of the first tread and the at least two of the at least three legs.

In one embodiment, there is a cane having a handle means for carrying the cane and for steadying a user of the cane, a platform means for stepping upon by the user, a platform means secured to the handle means, and an extension means for retractably extending the platform means.

In another embodiment, there is a method of climbing a vertical rise that includes positioning, at a bottom of a vertical rise, a cane having an extendable platform; extending the platform; stepping upon the platform; stepping off the platform onto a surface higher than the bottom of the vertical rise; and retracting the platform. In one embodiment, there is a method of climbing a vertical rise that includes extending a platform of cane including unfolding the platform and retracting the platform including folding the platform.

BRIEF DESCRIPTION OF THE DRAWINGS

Reference is made to the accompanying drawings in which are shown illustrative embodiments of the invention, from which its novel features and advantages will be apparent. In the drawings.

DESCRIPTION OF THE PREFERRED EMBODIMENTS

Reference will now be made in detail to preferred embodiments of the present invention, examples of which are illustrated in the accompanying drawings. Wherever possible, the same reference numbers will be used throughout the drawings to refer to the same or like parts. To provide a thorough understanding of the present invention, numerous specific details of preferred embodiments are set forth including material types, dimensions, and procedures. Practitioners having ordinary skill in the art, will understand that the embodiments of the invention may be practiced without many of these details. In other instances, well-known devices, methods, and processes have not been described in detail to avoid obscuring the invention.

The present invention is directed to a wheeled cane that will permit a person to walk along side the cane, using the cane for support substantially at all times without the need to lift the cane from the floor while walking. The present invention is also directed to a step-up cane that features at least one platform upon which a person can step as an intermediate point between vertical rises (e.g., stair treads, curbs, automobiles).

Figure 1A:
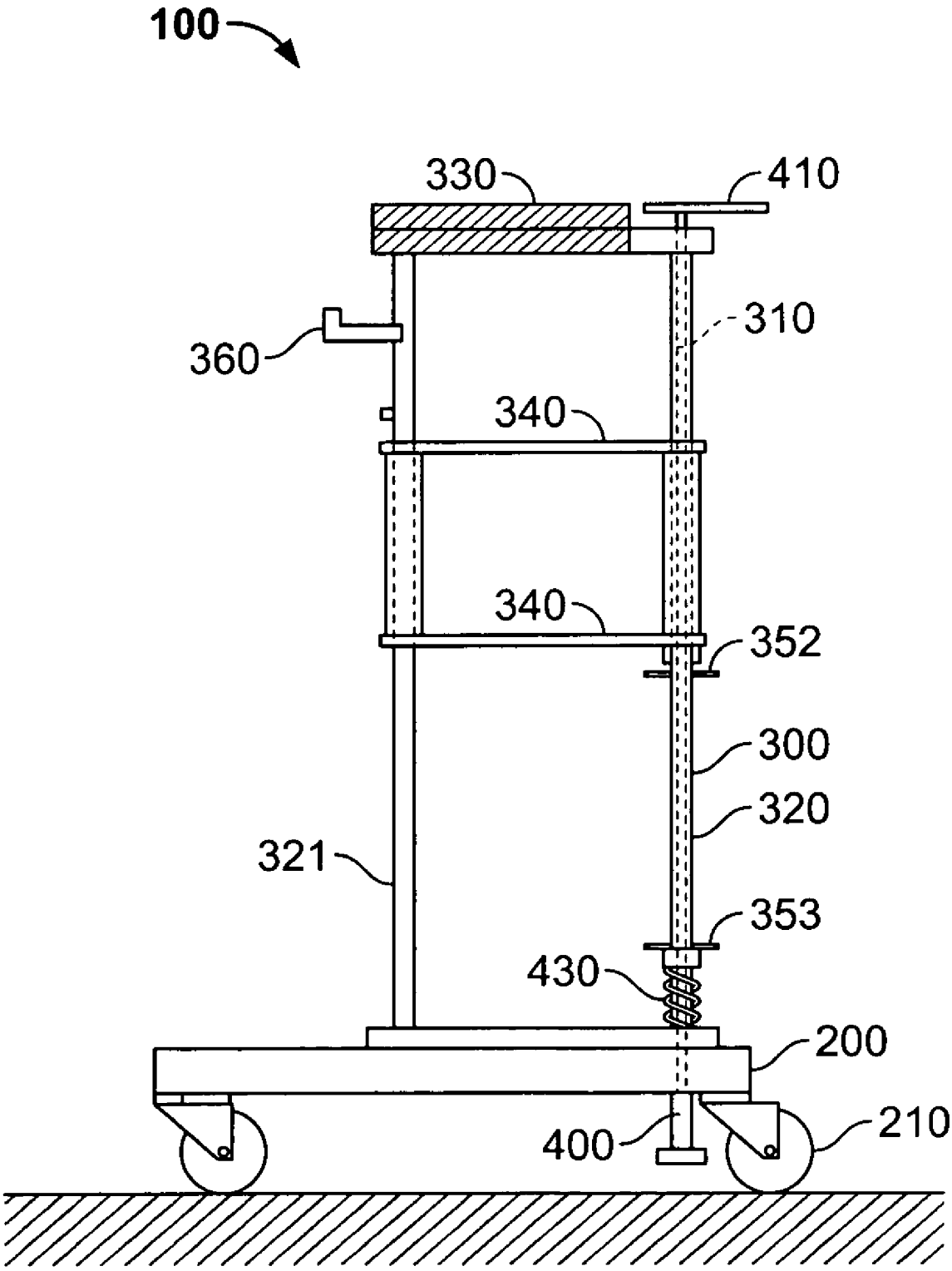
FIG. 1A shows a rolling cane according to the present invention.

FIG. 1A illustrates a cane 100 of the present invention. Cane 100 includes a base 200, a member (e.g., frame) 300 and a brake 400. Cane 100 and each component thereof may be constructed from metal, polymer, wood, fiberglass or any other suitable material or combinations of materials. Materials are preferably selected for their light weight, stiffness, durability, constructability and aesthetic appeal. In one embodiment, base 200 and frame member (e.g., frame) 300 are integrally cast or molded as a single piece.

Figure 2:
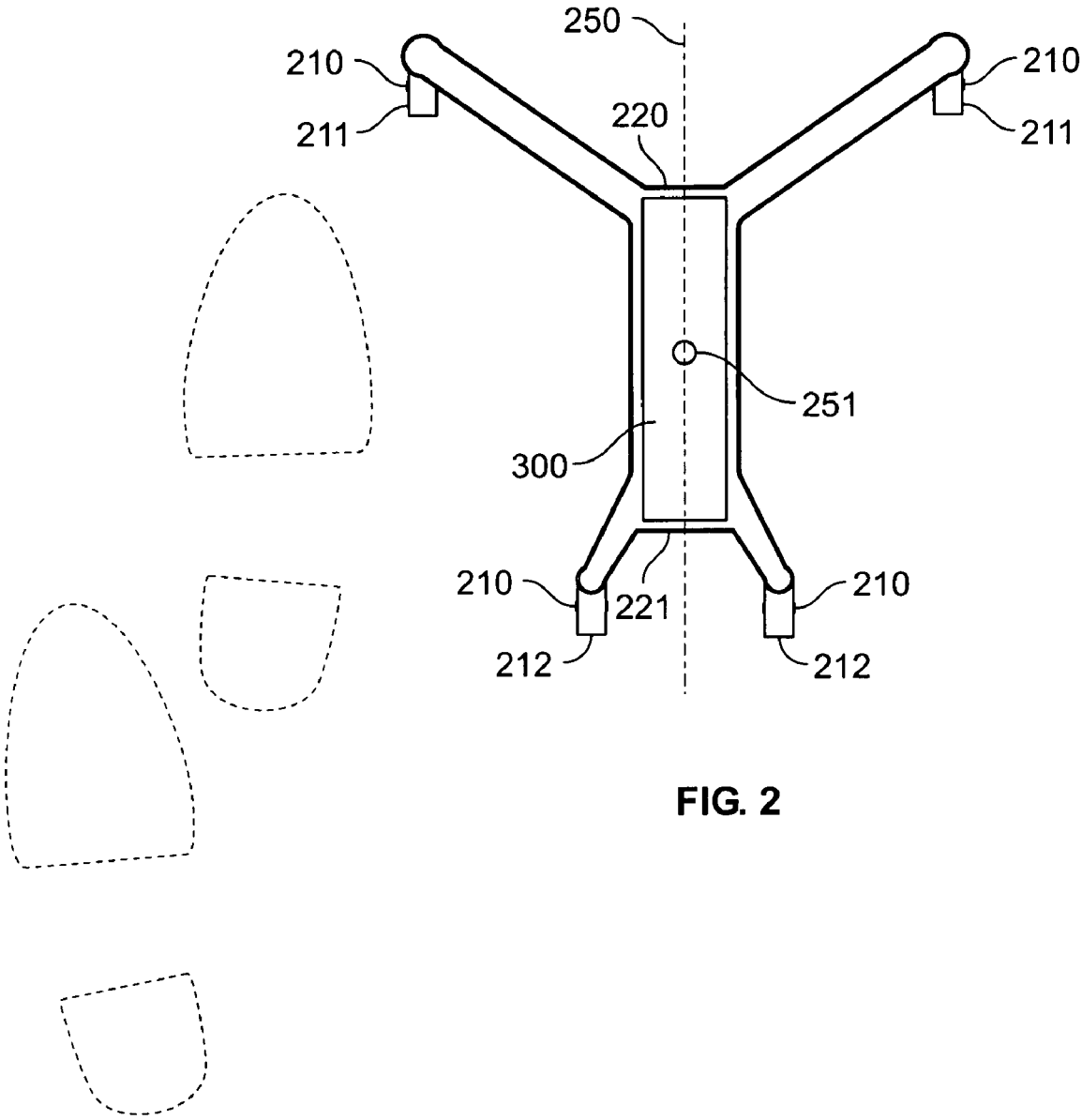
FIG. 2 shows a base of a rolling cane according to the present invention.

In one embodiment, illustrated in FIG. 2, base 200 has a centerline 250. Base 200 preferably has a plurality of wheels 210. Preferably, base 200 has a sufficient number of wheels 210 to permit cane 100 to remain free-standing when not in use. In one embodiment, cane 100 has skid pads (e.g., brake 2141 in FIG. 21) in place of one or more of wheels 210. In one embodiment (FIG. 2), base 200 has two forward wheels 211 on either side of centerline 250 and two rearward wheels 212 on either side of centerline 250. Forward wheels 211 are preferably offset further from centerline 250 than rearward wheels 212. Forward wheels 211 may be offset an equal or smaller distance from centerline 250 as rearward wheels 212. The difference in offset preferably accommodates a person's foot when they are walking along side cane 100. (FIG. 2). In one embodiment rearward wheels 212 are offset approximately two inches from centerline 250 and forward wheels 211 are offset approximately four inches from centerline 250. Those skilled in the art will understand that different offset distances will fall within the scope of this invention and will be determined by, for example, the size and weight support requirements of cane 100. In one embodiment, illustrated in FIG. 2, member (e.g., frame) 300 has a centerline 251 which is oriented along centerline 250. Forward wheels 211 are preferably offset a greater distance from center point 251 than rearward wheels 212. In one embodiment, forward wheels 211 are offset approximately four inches from centerline 251 and rearward wheels 212 are offset approximately two inches from centerline 251.

Figure 1B:
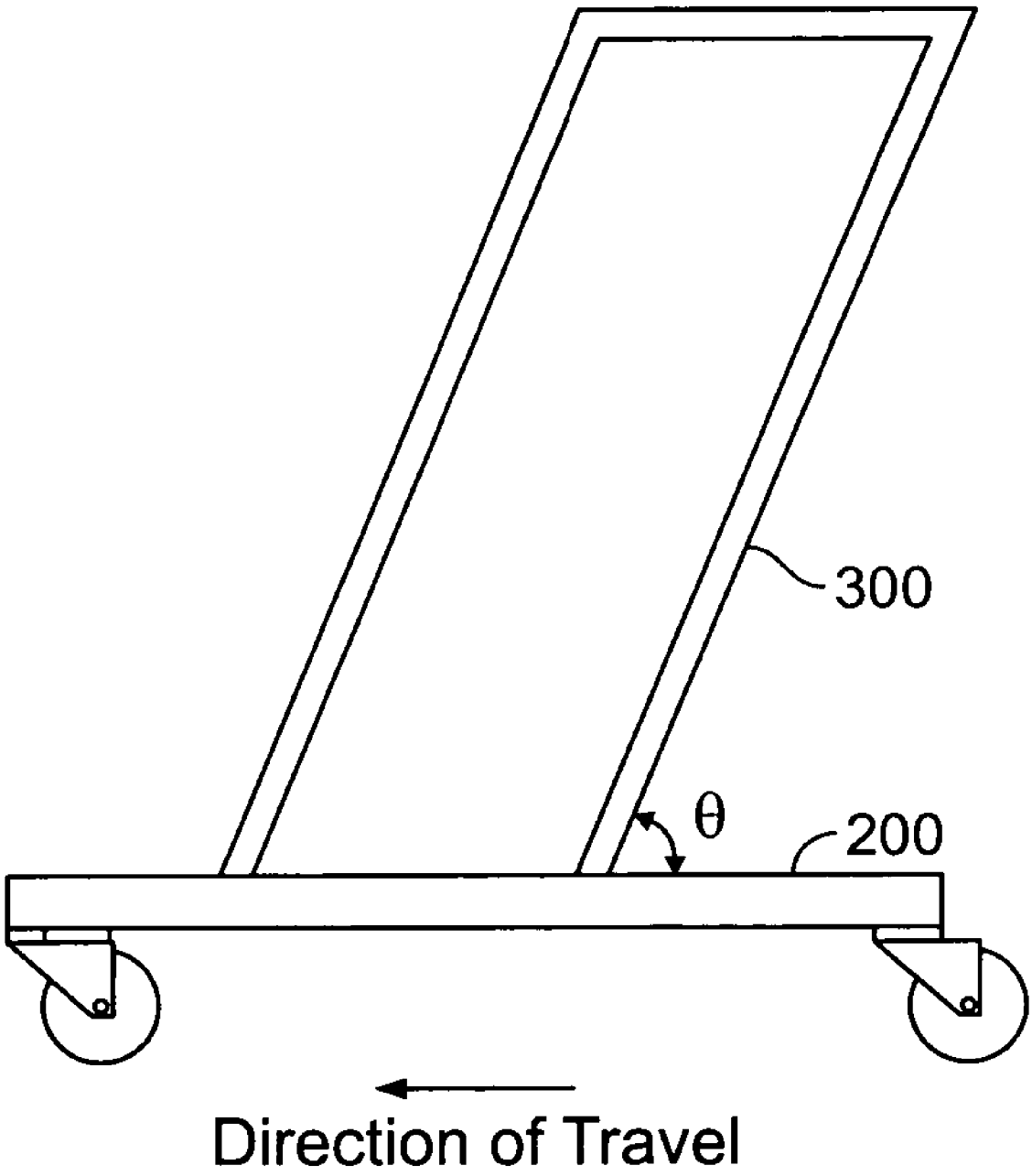
FIG. 1B shows a rolling cane having an angled frame according to the present invention.

Member (e.g., frame) 300 is preferably substantially vertical in relation to the floor surface or ground upon which a person is walking. In one embodiment member 300 is angled a dimension of between 0° and 10° off vertical and preferably approximately 6° from vertical. (FIG. 1B) Preferably, member 300 is angled away from the direction of travel. (FIG. 1B) Member 300 preferably has a hand grip 330. In one embodiment, member 300 is fixed to base 200 by means well known in the art (including e.g., welding, bolting, gluing, bonding, riveting). In one embodiment, member 300 and base 200 are integrally formed by, for example, casting or molding.

In one embodiment, illustrated in FIG. 1A, cane 100 has an aperture 310. Aperture 310 preferably extends vertically through cane 100 (e.g., from a point proximate handle 330 to a point below base 200). In one embodiment, shown in FIG. 1A, member 300 has two uprights 320, 321. In another embodiment, member 300 has a single upright or more than two uprights. Aperture 310 preferably extends through one of uprights 320, 321.

Figure 3:
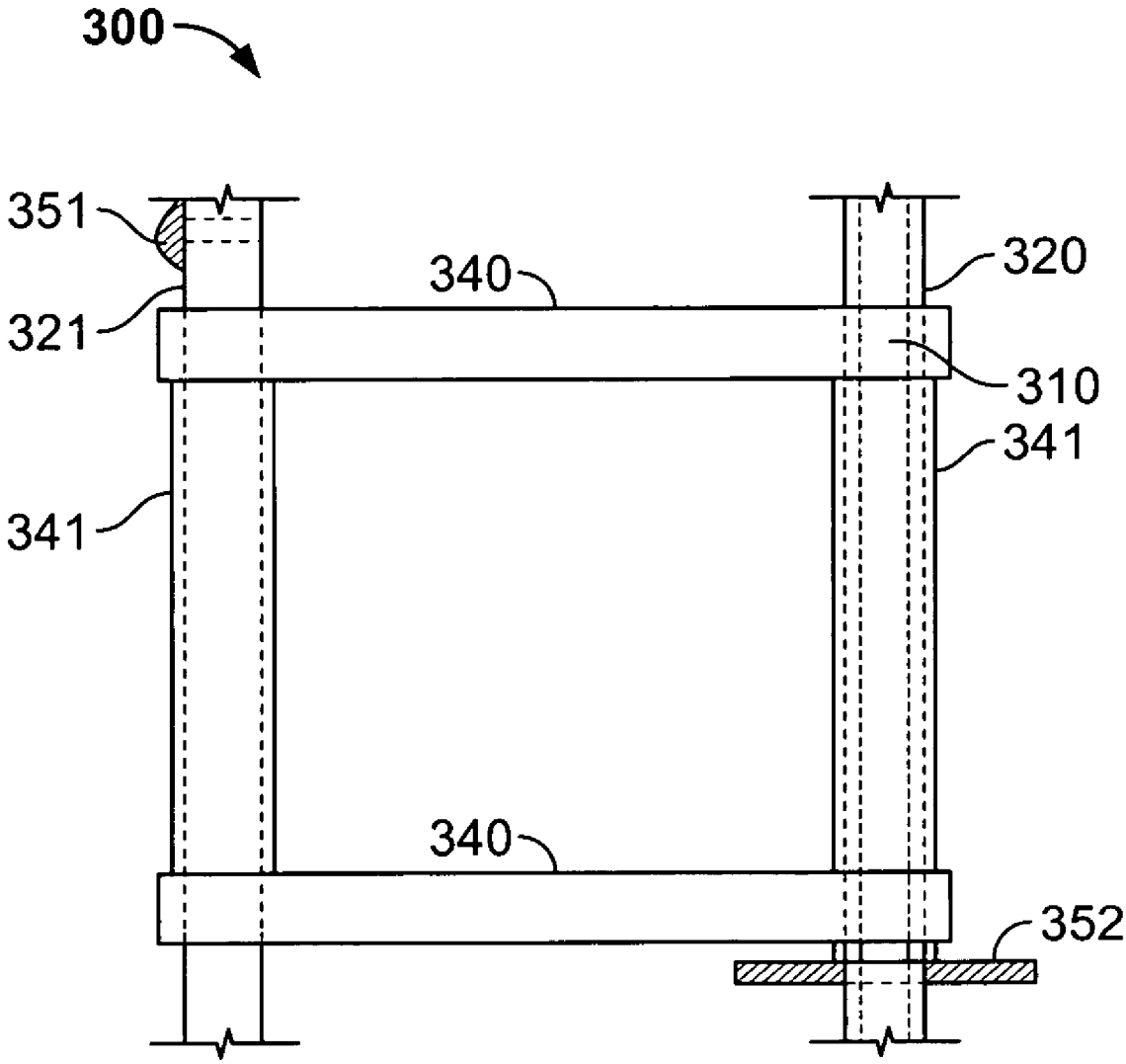
FIG. 3 shows cross members of a cane according to the present invention.

In one embodiment, illustrated in FIG. 3, member 300 includes one or more intermediate actuators (e.g., cross members 340). Cross member 340 preferably include sleeve 341 which surrounds upright 320, 321 allowing cross member 340 to slide vertically along member 300. The present invention may use any number of cross members 340. Preferably sleeve 341 forms a connection between two cross members 340 such that both cross members 340 move in unison vertically along member 300. As illustrated in FIG. 3, cross members 340 preferably have restrictions to vertical travel along uprights 341 by pins 351, 352. Pin 351 preferably restricts upward movement of cross member 340 and pin 352 preferably restricts downward movement of cross member 340. Pin 352 further engages brake 400 thereby permitting a person to apply downward pressure on cross member 340 to engage brake 400 (discussed in more detail below). Member 300 preferably includes one or more accessory attachment fixtures 360. Fixture 360 is preferably a hook adapted to carry, for example, a handbag. Fixture 360 may include a strap, a snap, Velcro®-type connections, a clip or any other type of attachment mechanism.

Figure 4:
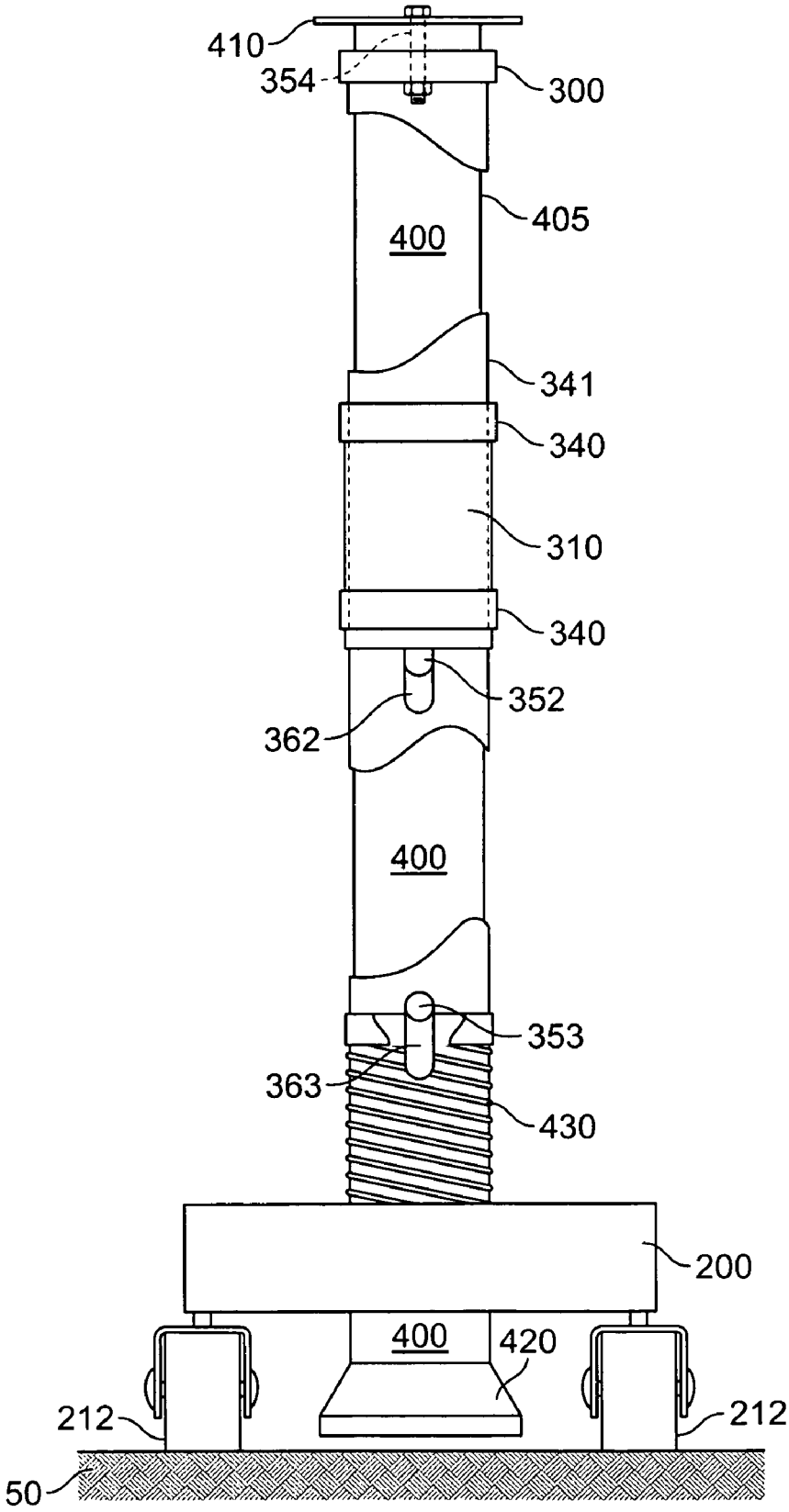
FIG. 4. shows a cut-away view of a brake of a cane according to the present invention.

Brake 400 preferably has a rigid rod 405. (FIG. 4) Rigid rod 405 preferably extends through aperture 310. Brake 400 has an actuator (e.g., pad) 410 which is fixed to rod 405, or preferably is integral with rod 405. Actuator 410 is preferably proximate handgrip 330. In a preferred embodiment, illustrated in FIG. 4, rod 405 extends from actuator 410 proximate handgrip 330 to floor 50, preferably through aperture 310. Brake 400 has a ground engaging means which is preferably a brake pad (e.g., stopper) 420 that is fixed to rod 405. In one embodiment stopper 420 is integral with rod 405 thereby forming a single piece. Stopper 420 may be any material but is preferably elastomer or some similar material with a high friction coefficient for engaging floor 50. In a preferred embodiment, brake 400 is extendable through aperture 310 by depressing actuator 410 downward.

Figure 7:
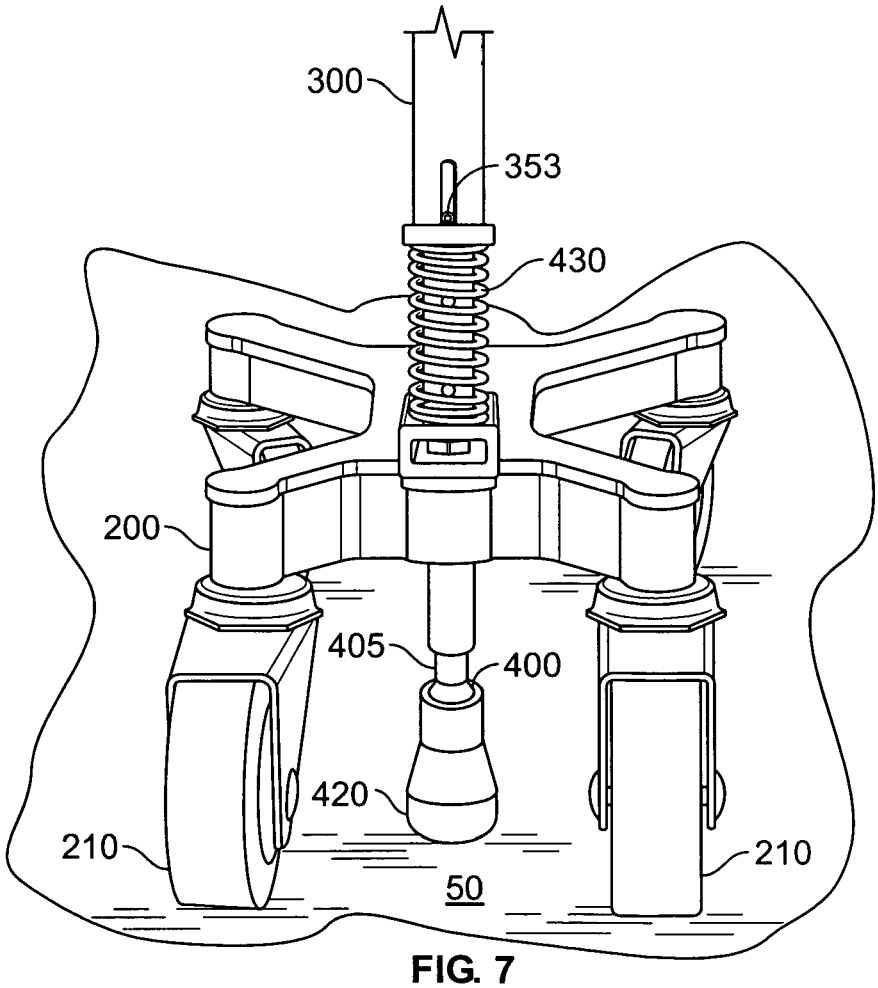
FIGS. 7-14 shows a rolling cane of the present invention.
Figure 8:
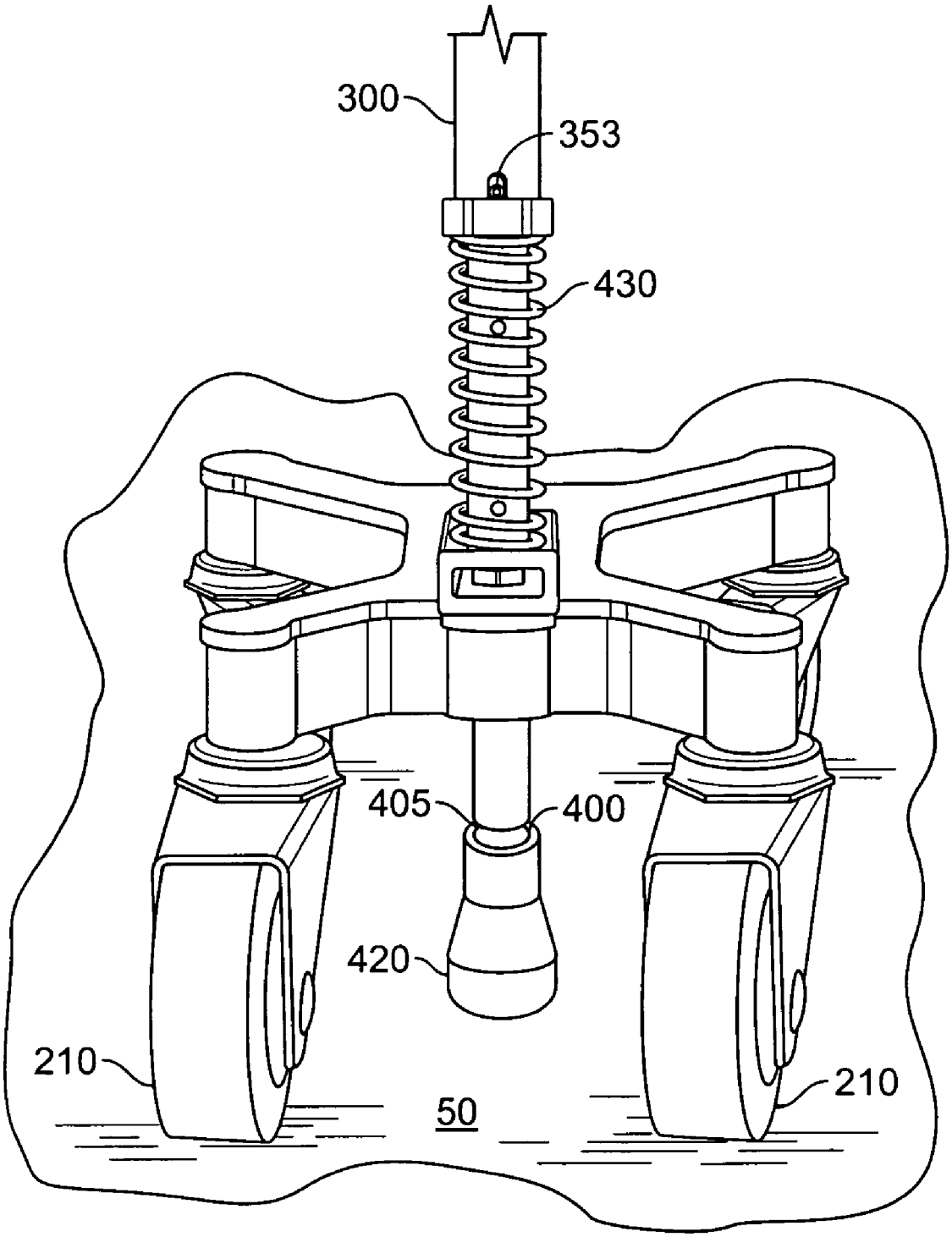
Figure 9:
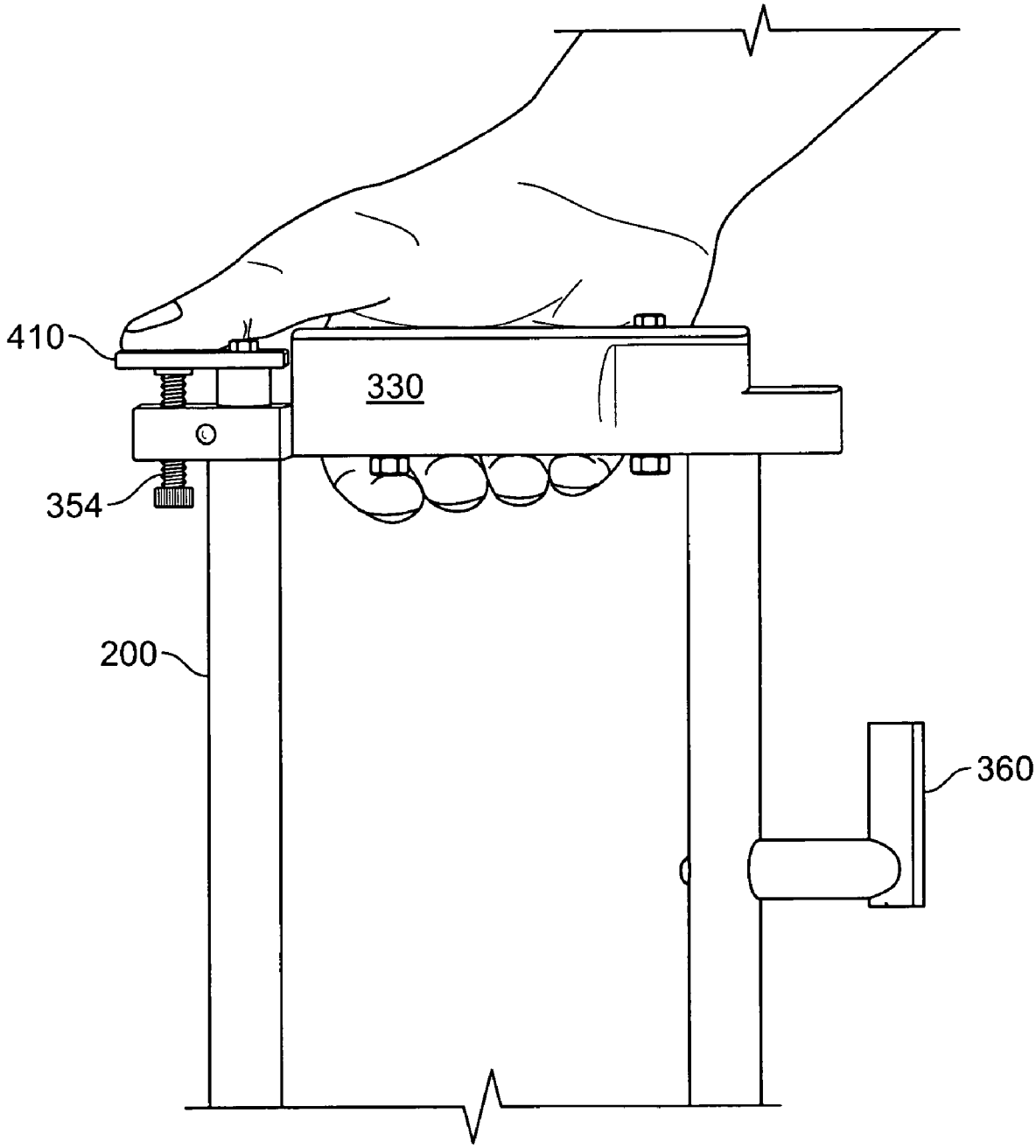

In a preferred embodiment, when actuator 410 is not being depressed, brake 400 retracts from floor 50 allowing cane 100 to roll unimpeded. Retraction of brake 400 is preferably achieved by a spring 430 which engages base 200 and brake 400. Spring 430 may engage brake 400 by any means but is preferably connected to brake 400 by pin 353. Pin 353 preferably extends from rod 405 outwardly from member 300 and rides in slot 363 of member 300. Thus, when actuator 410 is depressed with sufficient force, pin 353 depresses spring 430 until stopper 420 engages ground surface 50 (FIG. 7). When the downward pressure is removed, spring 430 expands against pin 353 and brake 400 retreats from surface 50 (FIG. 8). In one embodiment, to maintain the orientation of actuator 410 with hand grip 330, pin 354 may be extended from actuator 410 to frame 200 (FIG. 9).

Figure 10:
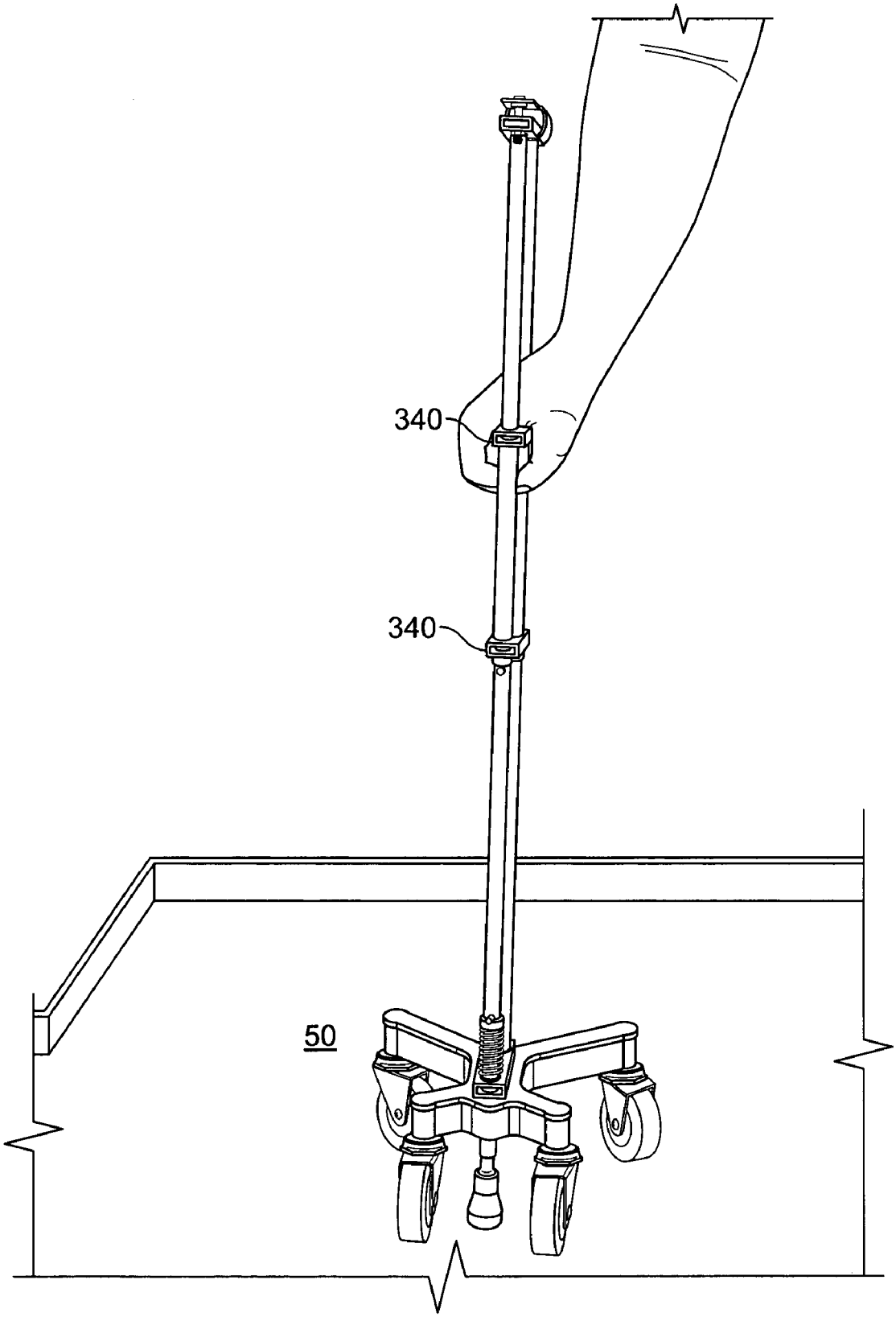
Figure 11:
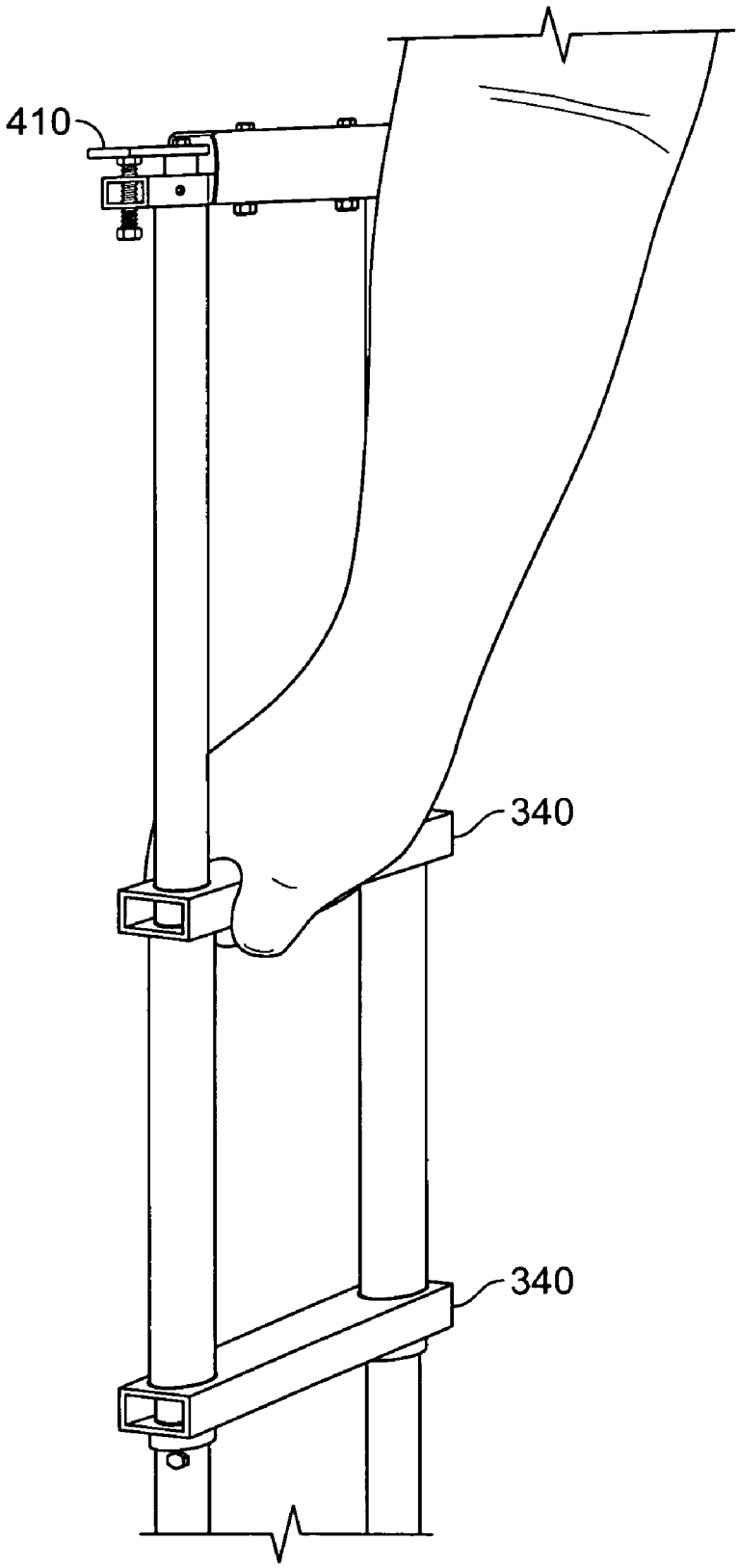
Figure 12:
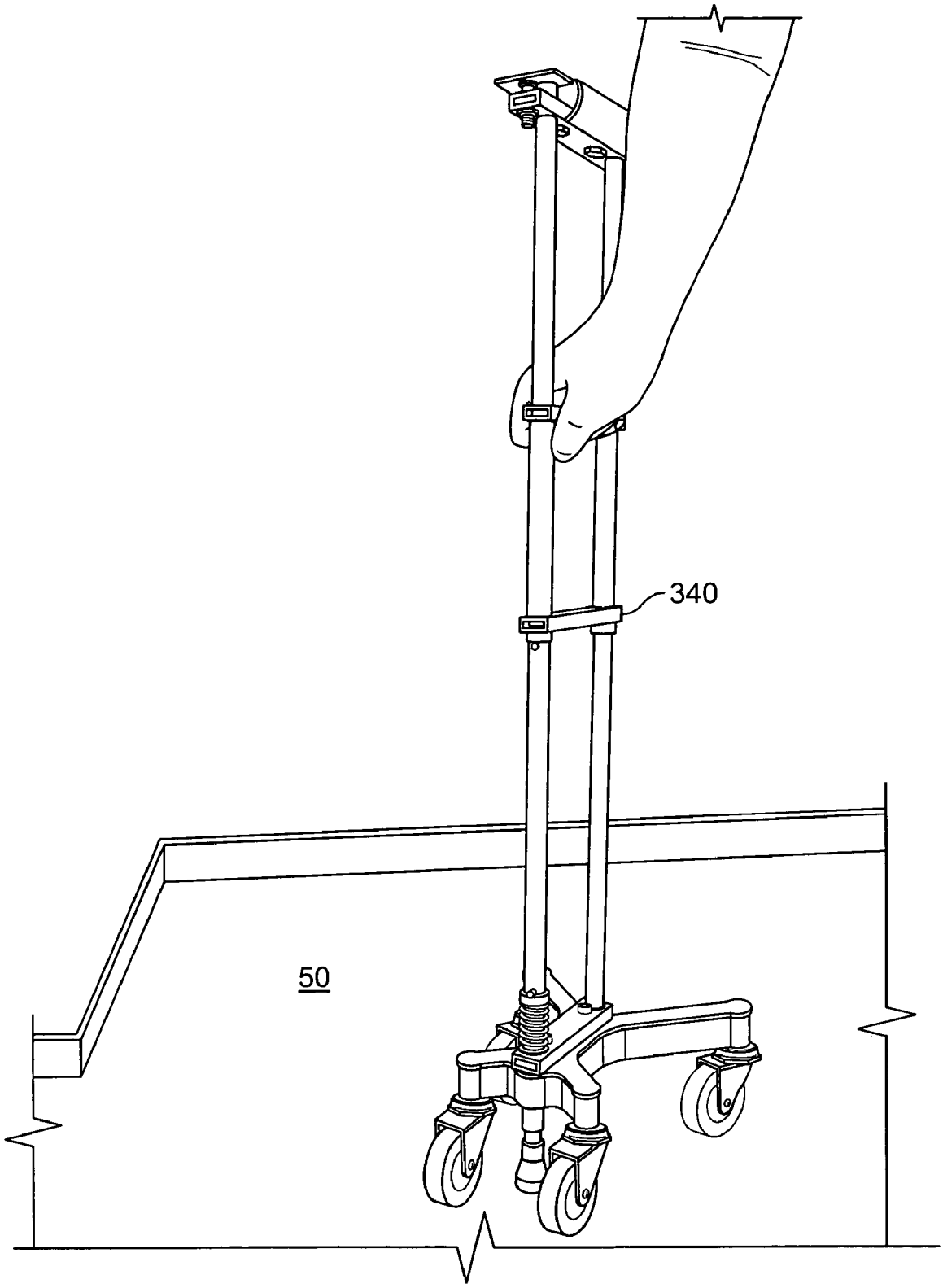
Figure 13:
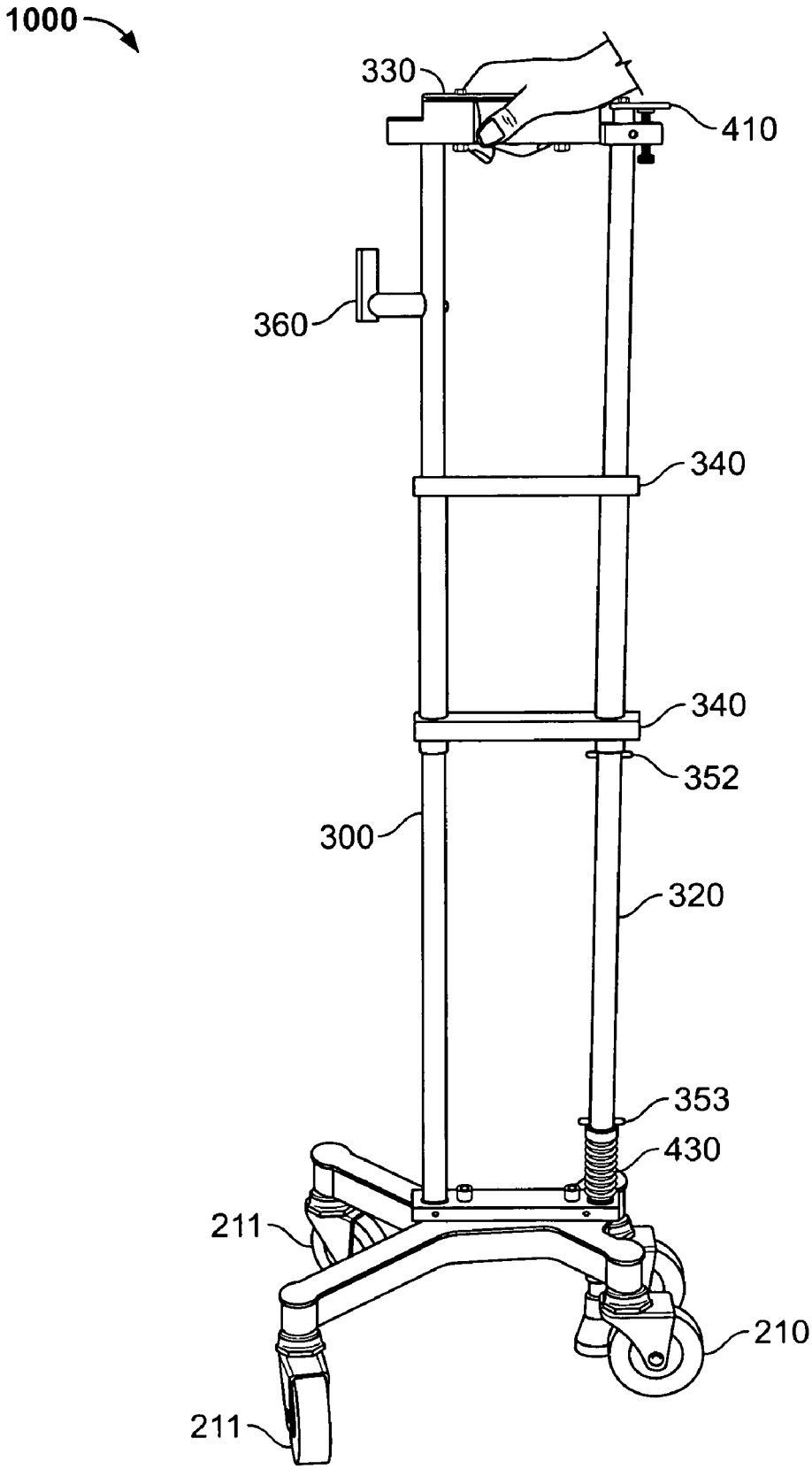
Figure 14:
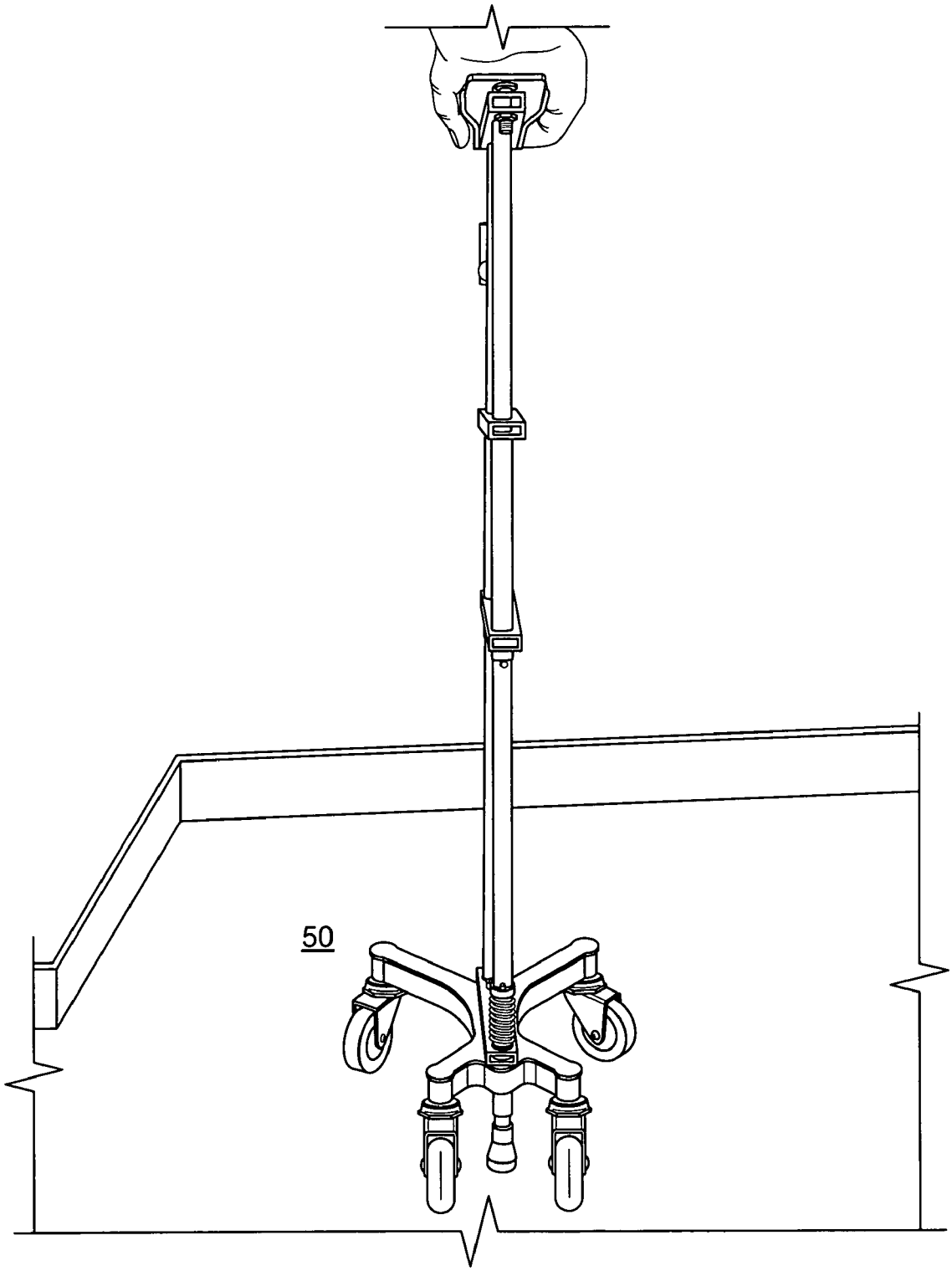
Figure 15:
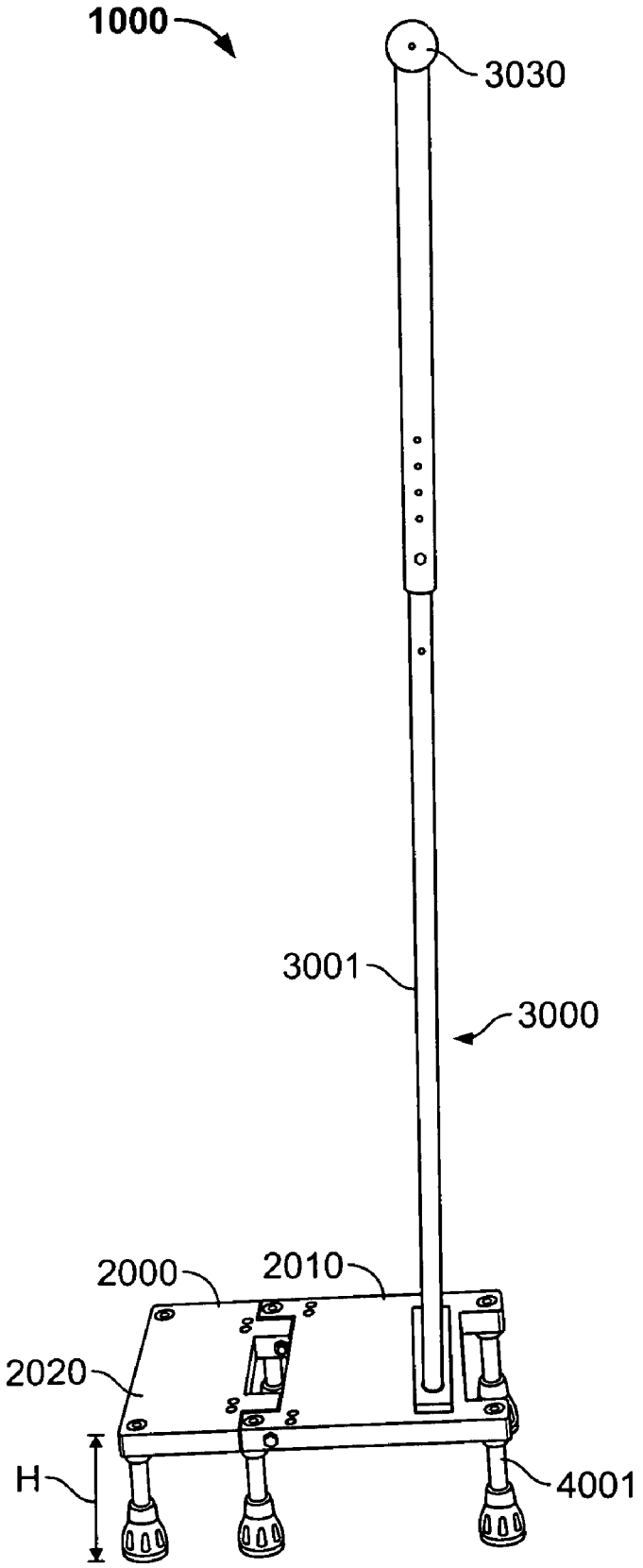
FIGS. 15-20 shows a step-up cane of the present invention.

Cross member 340 may similarly be employed to engage brake 400. By depressing cross member 340 with sufficient pressure to overcome the upward pressure of spring 430, cross member 340 preferably engages pin 352 thereby forcing brake 400 (e.g., at brake pad 420) to engage surface 50 (FIG. 10).

Thus, the present invention provides a useful means for a person to walk with continuous assistance from a cane without the need to lift the cane from surface 50. In a preferred means of operation, a person positions hand grip 330 in such a fashion as to orient pad 410 in the heal of the person's hand. Thus, while a person is walking using cane 200 brake 400 may be engaged in a simple motion of depressing the heal of the hand downward without removing the hand from handgrip 330.

The present invention also provides a useful apparatus to assist a person in standing from a sitting position. Cross members 340 are preferably positioned at a height that would enable a person to steady themselves for example, while sitting on a chair. The person then preferably depresses cross member 340 thereby engaging brake 400 with surface 50 to prevent cane 100 from rolling. In one embodiment, the person uses one or more of cross members 340 to assist them in standing without fear that the support will drift. When downward pressure is removed, brake 400 retracts from surface 50 and the person may then walk with assistance from cane 200.

Figure 5A:
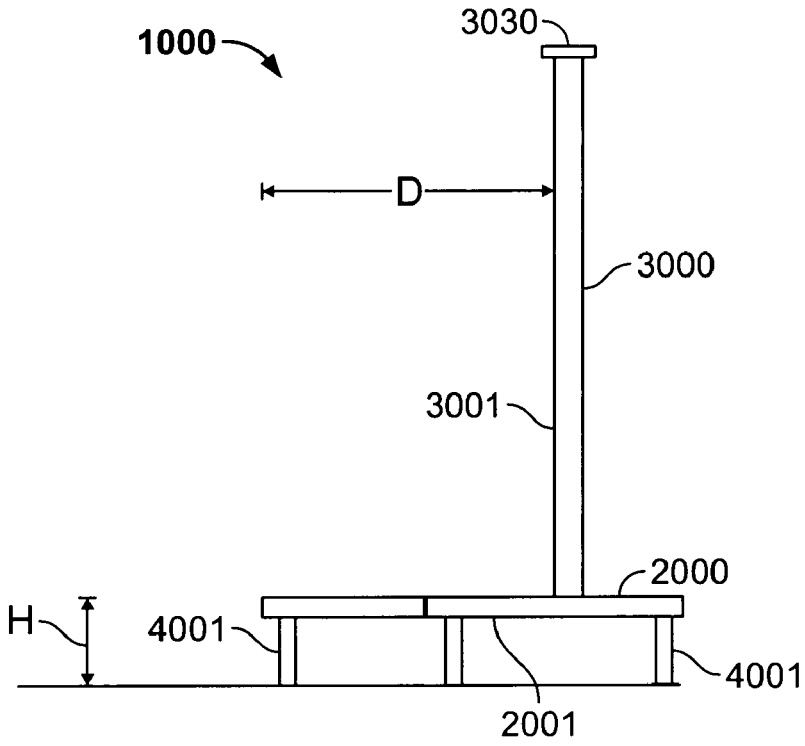
FIGS. 5A-5C shows a cane of the present invention.
Figure 5B:
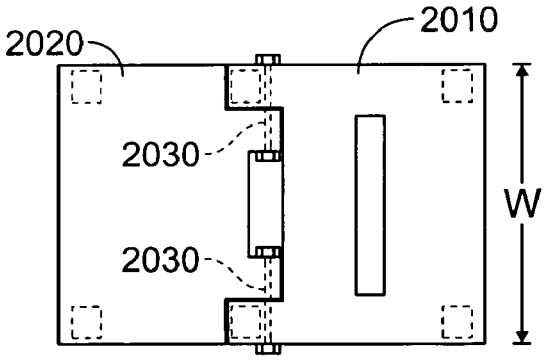
Figure 5C:
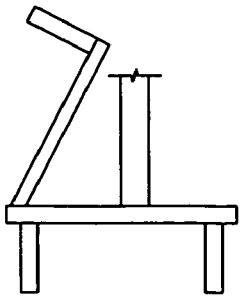
Figure 17:
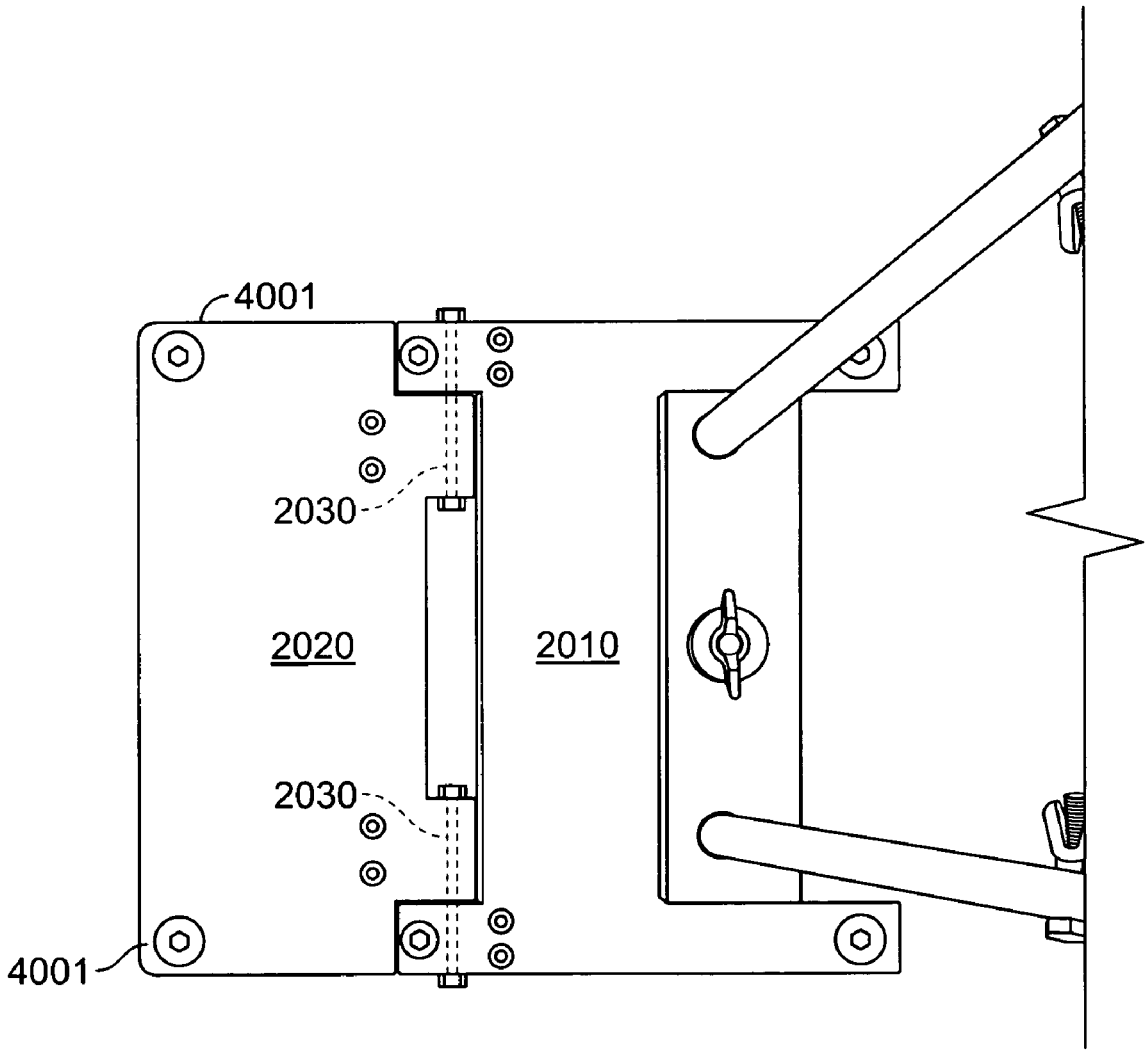

The present invention also includes a cane 1000 illustrated in FIG. 5. Cane 1000 has a base 2001 with at least one platform 2000, member (e.g., frame) 3000 and legs 4000. Member (e.g., frame) 3000 includes one or more uprights 3001 and a handgrip 3030. Member 3000 is oriented on any location relative to platform 2000 but is preferably offset to one side of platform 2000 (FIG. 17). Member 3000 is of a fixed height in one embodiment. In a preferred embodiment Member 3000 has an adjustable height.

Platform 2000 preferably has a first tread 2010 and a second tread 2020. In a preferred embodiment, first tread 2010 is fixed to frame 3000. In one embodiment, member 3000 and first tread 2010 are integral with one another (e.g., a casting). Second tread 2020 preferably extends from first tread 2010 in such a manner as to provide a surface upon which a person can stand with at least one foot. In a preferred embodiment, first tread 2010 and second tread 2020 are connected by a securement 2030. Securement 2030 may be any securement that enables second tread 2020 to extend from tread 2010. Securement 2030 is preferably a hinge. (FIG. 5) Platform 2000 has dimension D from member 3000 to the end of second tread 2020 that is preferably approximately 6½ inches. Platform 2000 has a width W of preferably approximately eight inches. Those skilled in the art will recognize that any dimension D or width W will fall within the scope of the invention. The size of platform 2000 may be optimized such that cane 1000 can be steadied on a lower surface (e.g., stair tread 620) (FIG. 6) thus enabling a person to stand on platform 2000 while cane 1000 is on the lower surface (e.g., tread 620).

Figure 16:
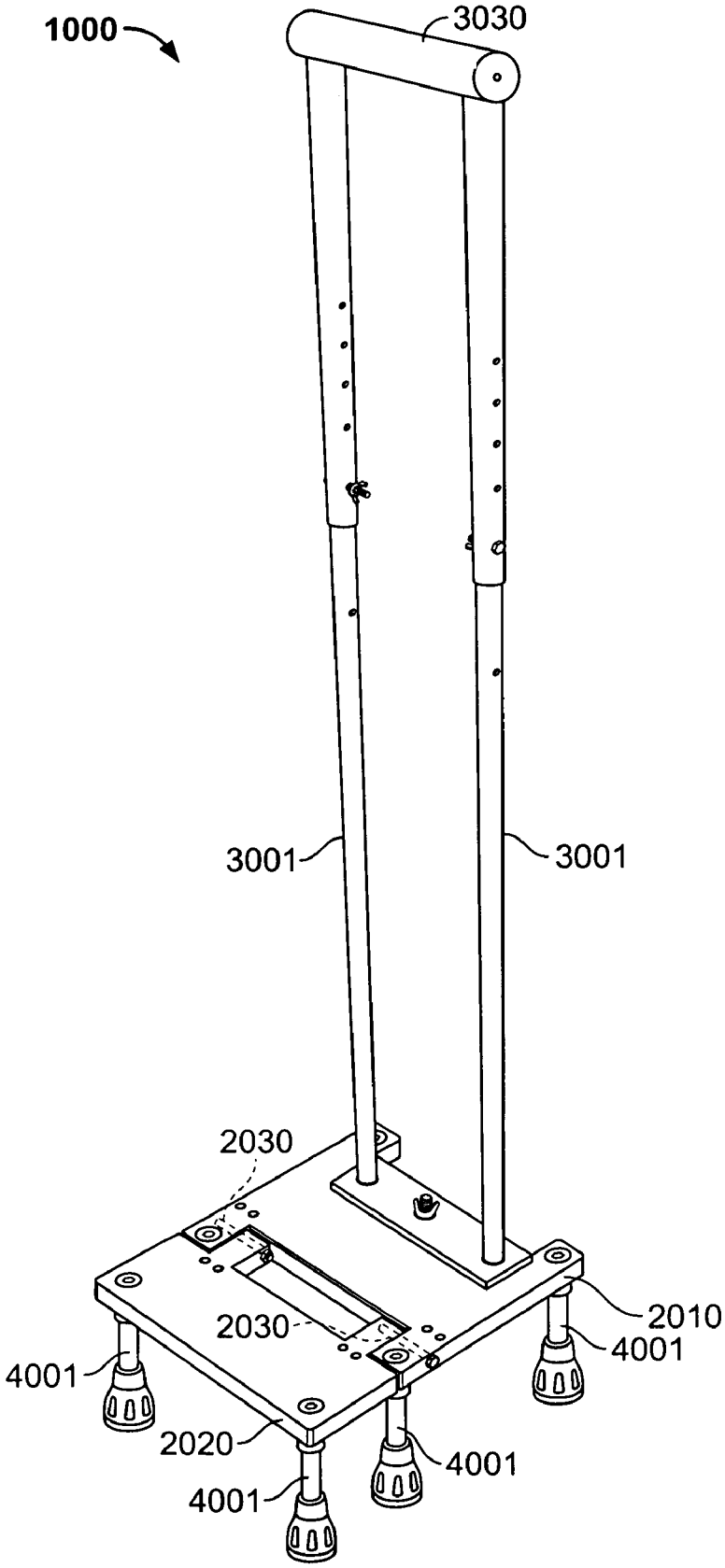

In a preferred embodiment, legs 4000 are attached to platform 2000. Though any number of legs may be useful for the purpose of the present invention, preferably four legs are attached to first tread 2010 and two legs are attached to second tread 2020. In one embodiment, three legs are attached to first tread 2010. In one embodiment, one leg is attached to second tread 2020. The number of legs 4000 in one embodiment is determined by the number necessary to enable cane 1000 to be free-standing when positioned on a surface (e.g., stair tread). In one embodiment (FIG. 16), six legs 4000 are attached to platform 2000; two legs 4001 proximate the outer edge of second tread 2020; two legs 4002 proximate securement 2030; and two leg 4003 proximate member 3000. (FIG. 16). In one embodiment legs 4003 proximate member 3000 are oriented on a side of frame 3000 opposite substantially all of platform 2000. (FIG. 16).

Figure 6:
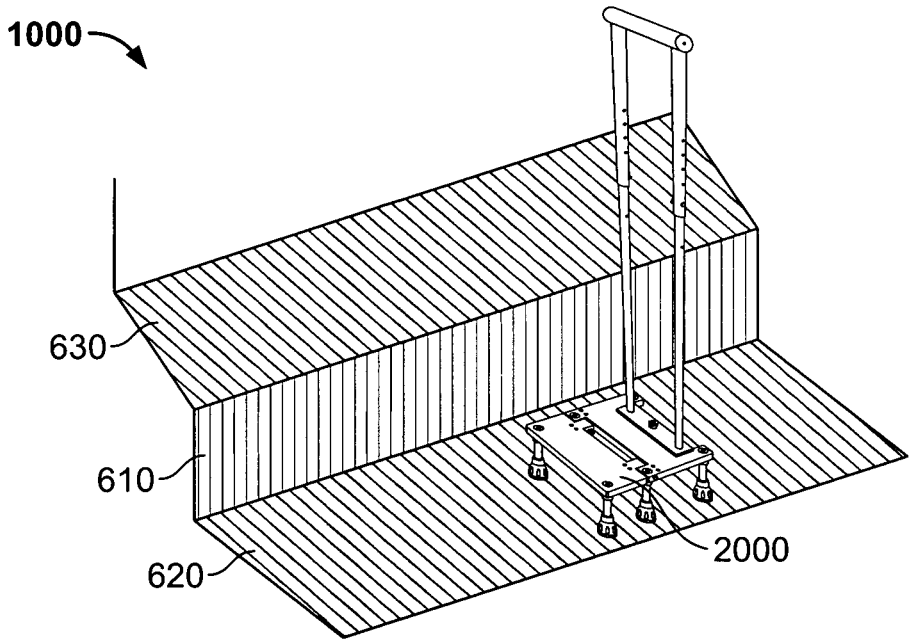
FIG. 6 shows a cane of the present invention on a stair.

Legs 4000 may be any height H and are preferably such a height H so that platform 2000 is approximately four inches above a lower surface (e.g., stair tread 620). (FIG. 6). In one embodiment a height H of four inches is preferable because that is approximately half the height of a stair riser 610. In practice, a person would position cane 1000 on a lower surface (e.g., stair tread 620) while standing on the lower surface (e.g., tread 620). To achieve the next higher surface (e.g., next higher step, curb, automobile interior), for example, a person may first step on platform 2000 then on the higher surface. From the higher surface, for example when a person wants to climb a set of stairs, the person would then position cane 1000 on the higher surface (e.g., tread 630) and repeat the process. In one embodiment, more than one platform 2000 may be included to provide a plurality of intermediate steps between vertical rise surfaces. The height of platform 2000 or the spacing between the more than one platform 2000 may be any height to accommodate the purpose.

Figure 18:
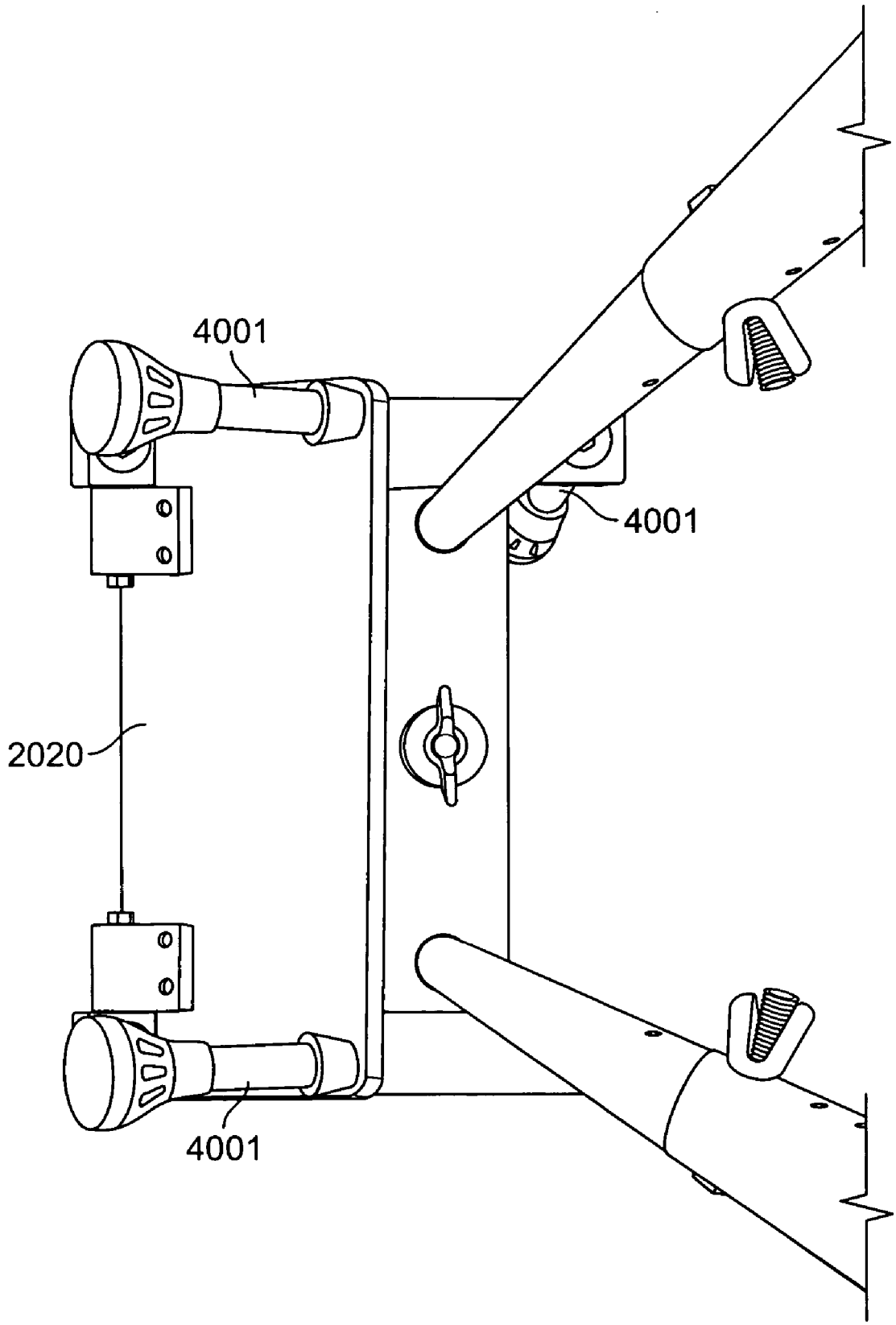
Figure 19:
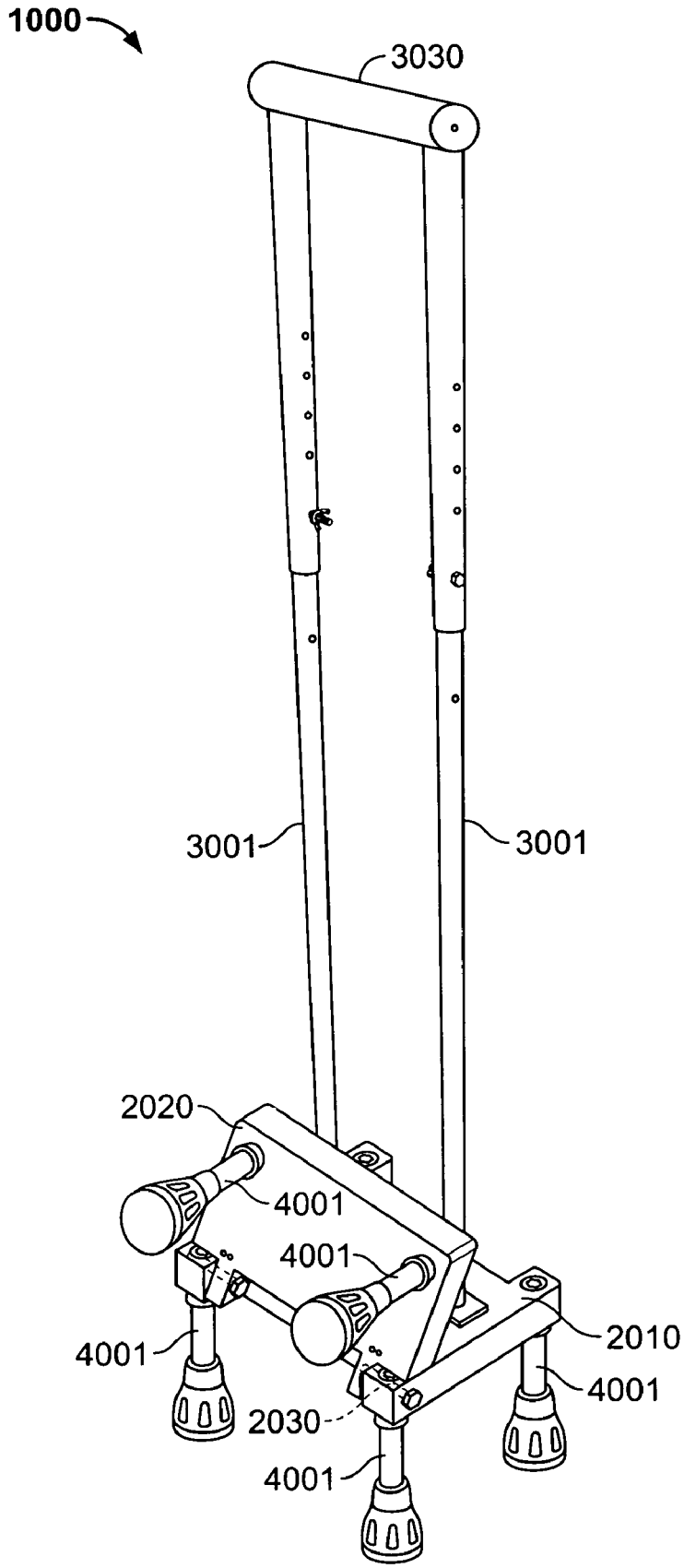
Figure 20:
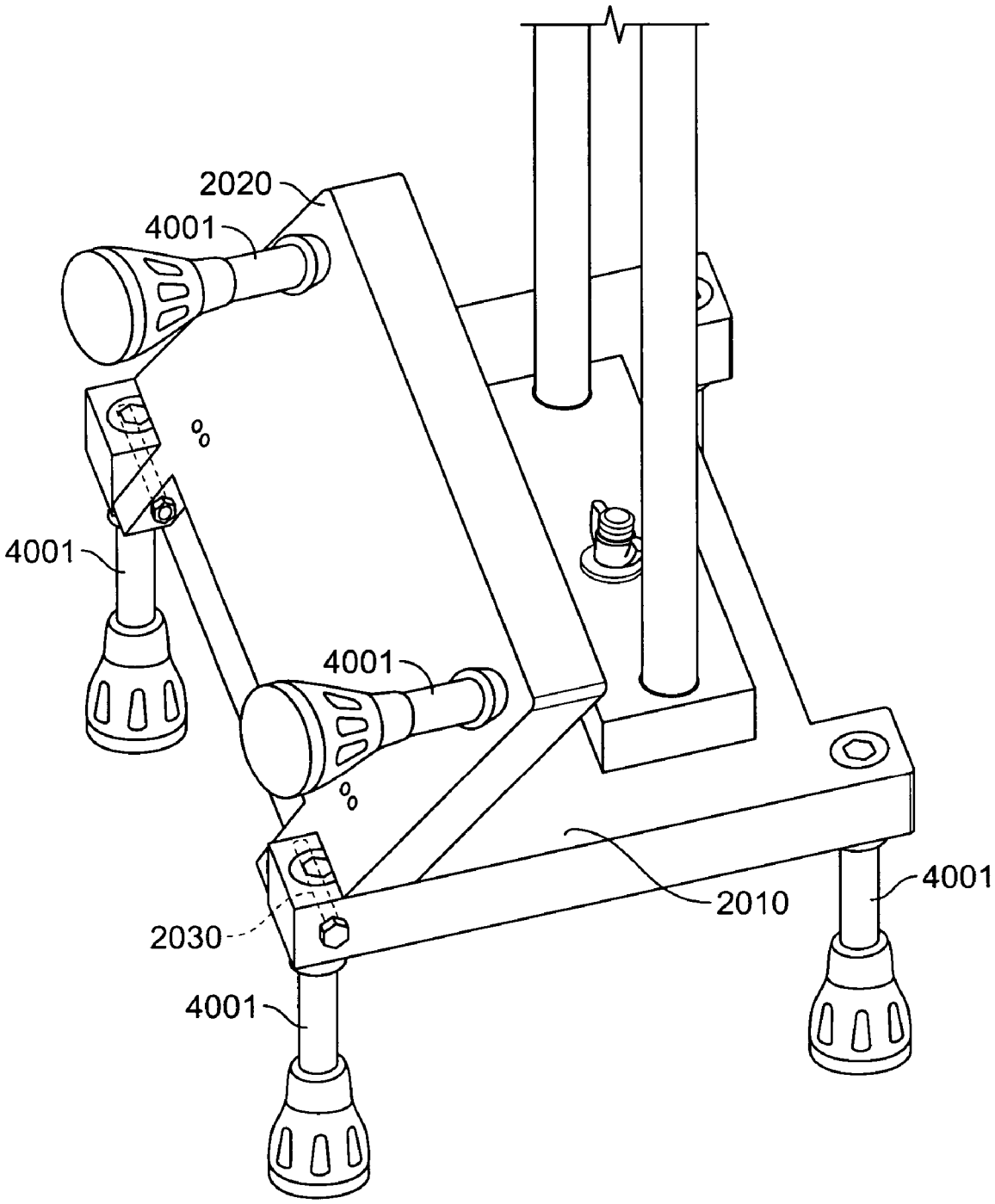
Figure 21A:
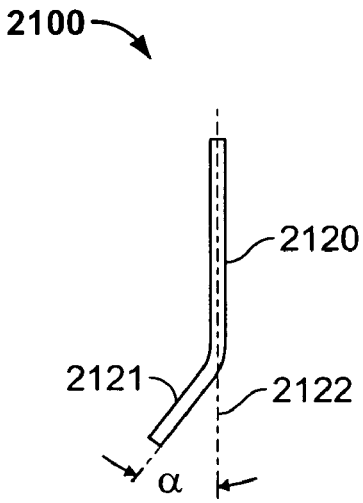
FIGS. 21A-21D shows a rolling cane according to the present invention.
Figure 21B:
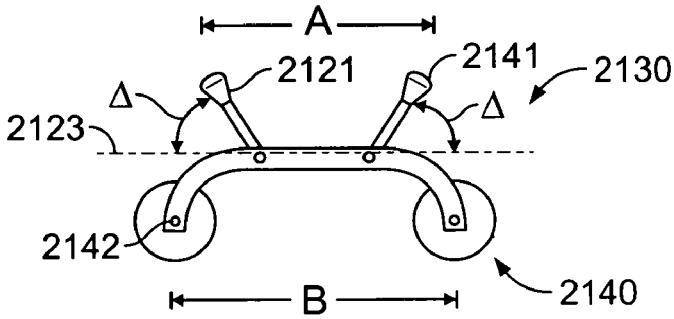
Figure 21C:
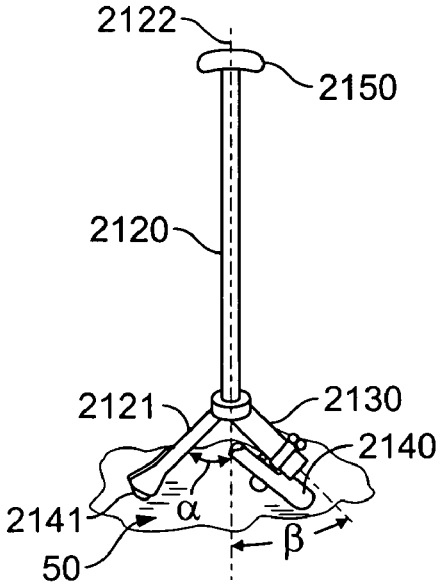
Figure 21D:
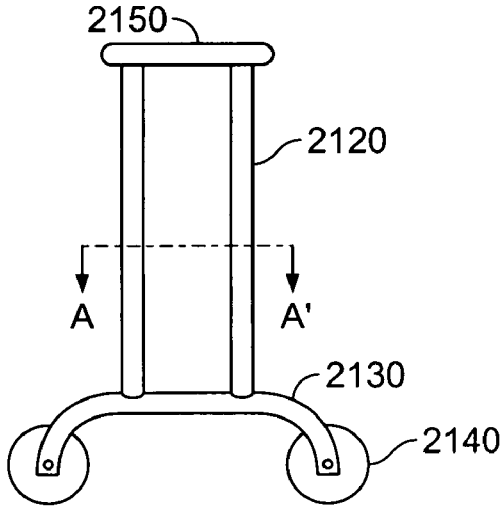

In a preferred embodiment, when cane 1000 is not being used to assist in the climbing of vertical rises, second tread 2020 may be retracted to facilitate the use of cane 1000 for walking. (FIGS. 18, 19, 20). In one embodiment, second tread 2020 is folded over first tread 2010 via securement 2030 (e.g., a hinge). (FIGS. 18, 19, 20).

There is illustrated in FIG. 21, a rolling cane 2100 of the present invention. Cane 2100 at least one upright post 2120. Upright post 2120 preferably has a longitudinal axis 2122. Upright post 2120 preferably includes a brake (e.g., a stem) 2121 which is oriented at angle $\alpha$ to longitudinal axis 2122. In a preferred embodiment, a is approximately 45°. Brake 2121 preferably has a stopper 2141. Stopper 2141 is preferably made of elastomer or some other high friction material. In one embodiment, cane 2100 preferably has two upright posts 2120 that are preferably connected by a handle 2150. In an embodiment with two upright posts 2120 and two stoppers 2141, stoppers 2141 are spaced a distance A from one another. In a preferred embodiment, A is approximately eight to twelve and preferably ten inches.

Cane 2100 also has a base 2130. Base 2130 may be attached to upright 2120 or it may be integral with upright 2120 or brake 2121 (e.g., cast as one piece). In one preferred embodiment, base 2130 is arc shaped with each end of the arc being configured to accept an axle 2142. Wheels 2140 are preferably connected to base 2130 via axle 2142. Wheel 2140 may be attached to base 2130 in any other manner known to those skilled in the art. Base 2130 is preferably oriented to upright 2120 such that it forms an angle $\beta$ with longitudinal axis 2122. In a preferred embodiment, $\beta$ is approximately 45°. In one embodiment, wheels 2140 are spaced apart a distance B. In a preferred embodiment, B is approximately ten to fifteen and preferably thirteen inches. Wheels 2140 are approximately three to eight and preferably five inches in diameter. In one embodiment, larger diameter (e.g., 8 inches) wheels 2140 are preferable for outdoor use and smaller diameter (e.g., 3 inches) wheels 2140 are preferable for indoor use.

In one embodiment, illustrated in FIG. 21, cane 2110 has a transverse axis 2123. Stems 2121 are preferably oriented at an angle $\Delta$ relative to transverse axis 2132. In a preferred embodiment, $\Delta$ is approximately 45°.

When not in use, longitudinal axis 2122 is preferably approximately normal to ground surface 50 and cane 2100 is free-standing. When in use one may tilt cane 2100 from its free standing position toward a user such that stopper 2141 leaves ground surface 50. In a preferred embodiment, wheels 2140 are oriented more upright than in the free-standing position as a user rolls cane 2100 as they walk. To stop wheels 2140 from rolling, one may merely return cane 2100 to its free-standing position to engage stopper 2141 with ground surface 50.

Although the foregoing description is directed to the preferred embodiments of the invention, it is noted that other, variations and modifications in the details, materials, steps and arrangement of parts, which have been herein described and illustrated in order to explain the nature of the preferred embodiment of the invention, will be apparent to those skilled in the art, and may be made without departing from the spirit or scope of the invention. Any dimensions referenced herein are preferred approximate dimensions. Those skilled in the art will recognize that any dimensions selected to achieve the objectives of the present invention are within the scope thereof.

What is claimed is:

1. A cane comprising:

a substantially vertical member having a handle, a base attached to the substantially vertical member and having at least three legs, the base having a first tread proximate the substantially vertical member, a second tread rotatably fixed to the first tread, the second tread having at least one leg and being rotatable from a retracted position wherein the second tread is folded over the first tread to an extended position wherein the first tread and the second tread forms a platform to allow a person to step thereon and wherein the cane is configured as a walking aid in the retracted position.

2. The cane of claim 1 wherein the first tread and the second tread are configured to form a flat platform in the extended position.

3. The cane of claim 1 wherein second tread is rotatably fixed to the first tread by a hinged securement that is not readily removable from the first tread and the second tread.

4. The cane of claim 1 configured to be free-standing in the retracted position and in the extended position.

5. The cane of claim 1 wherein the first tread has four legs.

6. The cane of claim 1 wherein the second tread has two legs.

7. The cane of claim 3 wherein the first tread has four legs, two of the four legs being proximate the upright and two of the four legs being proximate the hinged securement, and wherein the second tread has two legs proximate an outer edge of the second tread.

8. The cane of claim 1 further configured for the first tread to be positioned between a surface upon which the cane stands and a higher surface.

9. The cane of claim 1 wherein the first tread and the second tread are configured to form an extended platform configured to fit on a stair tread.

10. The cane of claim 1 wherein the substantially vertical member has a plurality of uprights.

11. The cane of claim 1 wherein the substantially vertical member is oriented proximate a side of the base such the substantially vertical member is disposed between a majority of the first tread and the side of the base.

12. The cane of claim 1 wherein at least two of the three legs are disposed on a side of the base wherein the substantially vertical member is disposed between substantially all of the first tread and the at least two of the at least three legs.

13. A method of climbing a vertical rise comprising:

positioning at a bottom of a vertical rise a cane having an extendable platform with an upright proximate a first tread pivotably fixed to a second tread;

the upright having a handle, the first tread having at least three legs, and the second tread having at least one leg;

extending the platform by pivoting the second tread relative to the first tread;

stepping upon the extended platform;

stepping off the extended platform onto a surface higher than the bottom of the vertical rise; and retracting the platform by pivoting the second tread over the first tread.

14. The method of claim 13 wherein the extending the platform comprises unfolding the platform and wherein retracting the platform includes folding the platform.

* * * * *